US008562089B2

(12) United States Patent
Collins et al.

(10) Patent No.: US 8,562,089 B2
(45) Date of Patent: Oct. 22, 2013

(54) REFRIGERATOR SHELF RETAINER AND DIVIDER ASSEMBLY FOR TALL PACKAGES

(75) Inventors: Clint J. Collins, Bondurant, IA (US); Lawrence J. Ertz, Amana, IA (US); Jonathan J. Tiemeier, Cedar Rapids, IA (US)

(73) Assignee: Whirlpool Corporation, Benton Harbor, MI (US)

( * ) Notice: Subject to any disclaimer, the term of this patent is extended or adjusted under 35 U.S.C. 154(b) by 1836 days.

(21) Appl. No.: 11/033,533

(22) Filed: Jan. 12, 2005

(65) Prior Publication Data

US 2006/0152123 A1 Jul. 13, 2006

(51) Int. Cl.
*A47B 96/04* (2006.01)

(52) U.S. Cl.
USPC ..... 312/405.1

(58) Field of Classification Search
USPC ..... 312/404, 405.1, 321.5, 408; 108/60, 61; 211/184, 88.01, 126.2, 103, 207; 220/532, 543, 544; 62/465, 466
See application file for complete search history.

(56) References Cited

U.S. PATENT DOCUMENTS

| | | | | | |
|---|---|---|---|---|---|
| 1,936,517 | A | * | 11/1933 | Maine | 62/466 |
| 2,095,810 | A | * | 10/1937 | Goulooze | 211/88.01 |
| 2,453,387 | A | * | 11/1948 | Rundell | 312/248 |
| 2,576,691 | A | | 11/1951 | Money | |
| 2,668,423 | A | * | 2/1954 | Petkwitz | 62/441 |
| 2,688,409 | A | * | 9/1954 | Echlin | 211/184 |
| 2,746,828 | A | | 5/1956 | Amore | |
| 3,156,509 | A | * | 11/1964 | Padgett | 312/405.1 |
| 3,285,424 | A | * | 11/1966 | Emery | 211/55 |
| 3,708,576 | A | | 1/1973 | Lemoine | |
| 3,709,576 | A | * | 1/1973 | Lemoine | 312/321.5 |
| 3,893,739 | A | * | 7/1975 | Bernard | 312/321.5 |
| 4,770,314 | A | * | 9/1988 | Giesler | 220/544 |
| 4,809,856 | A | * | 3/1989 | Muth | 211/184 |
| 5,160,191 | A | | 11/1992 | Holland et al. | |
| 5,226,717 | A | | 7/1993 | Hoffman | |
| 5,322,366 | A | | 6/1994 | Revlett et al. | |
| 5,445,452 | A | | 8/1995 | Kauffman et al. | |
| 5,567,029 | A | | 10/1996 | Haenisch | |
| D385,287 | S | | 10/1997 | Westcott | |
| 5,765,390 | A | | 6/1998 | Johnson et al. | |
| 5,951,134 | A | * | 9/1999 | Braun et al. | 312/405.1 |
| 6,039,424 | A | | 3/2000 | Pink | |
| 6,186,608 | B1 | | 2/2001 | Pink | |
| 6,220,684 | B1 | | 4/2001 | Bent et al. | |
| 6,227,636 | B1 | * | 5/2001 | Lye et al. | 312/408 |
| D468,326 | S | | 1/2003 | Lorek et al. | |
| D468,327 | S | | 1/2003 | Lorek et al. | |
| D468,329 | S | | 1/2003 | Kwak | |

FOREIGN PATENT DOCUMENTS

| | | |
|---|---|---|
| EP | 0634616 | 1/1995 |
| JP | 9215543 | 8/1997 |

* cited by examiner

*Primary Examiner* — Darnell Jayne
*Assistant Examiner* — Matthew Ing

(57) ABSTRACT

A retainer including a front wall, a back wall, and opposing side walls defining a ring having a central opening is removably attached to a liner of a refrigerator door at a position spaced above a shelving unit. With this arrangement, a tall food item supported on the shelving unit and having an upper portion which projects through the central opening is prevented from falling when the refrigerator door is opened. A divider may be slidably attached to the retainer or shelving unit for laterally retaining the tall food items on the shelving unit in a snug configuration.

4 Claims, 4 Drawing Sheets

REFRIGERATOR SHELF RETAINER AND DIVIDER ASSEMBLY FOR TALL PACKAGES

BACKGROUND OF THE INVENTION

1. Field of the Invention

The present invention pertains to the art of refrigerators and, more particularly, to an assembly for retaining food on a shelf in a refrigerator.

2. Discussion of the Prior Art

In the art of refrigerators, fresh food compartment doors are generally formed from an outer metal shell to which is attached a plastic inner wall defining liner. It is known to provide such liners with shelving units to support a wide range of food items. Such shelving units can be constituted by planar dike portions of the liner, pick-off buckets removably attached to the liner, or the like. In any case, when supporting food items on such shelving units, it is desirable to prevent the food items from becoming dislodged or shifting upon a sudden movement of the fresh food compartment door.

To prevent food items from undesirably shifting, it is known to employ a divider which essentially separates a storage shelving unit into various, smaller sections, thereby limiting the permissible shifting of food items stored thereon. It is also known to provide a slidable retainer in connection with a refrigerator shelving unit wherein the retainer can be manually slid into engagement with one or more food items supported on the shelving unit in order to limit shifting of the food items. One exemplary arrangement of this type is disclosed in connection with a dairy compartment in U.S. Pat. No. 5,765,390.

Even when a slidable retainer is used, tall packages have a tendency to tip or fall off refrigerator door shelves due to abrupt movements of the door. In an attempt to solve this problem, many refrigerator door shelves or buckets have been equipped with retainers for preventing forward movement of tall packages. For example, U.S. Pat. No. 5,567,029 discloses a retainer assembly positioned above a refrigerator shelf. The retainer assembly includes a bar for preventing tall containers from falling forward off the shelf and finger members for preventing food containers from toppling over laterally onto each other. However, in this and other known divider and retainer arrangements, the retainer is positioned in a fixed location and the consumer does not have the ability to remove or position the retainer in any desired position.

Regardless of the availability of dividers and retainers for limiting the shifting of food items stored on refrigerator shelving units, there still exists a need in the art for a retainer assembly which will effectively prevent tall packages from falling forward off a shelf, as well as from falling over laterally on the shelf. Particularly, there exists a need for such a retainer assembly that can securely hold tall items in desired positions, while being easily removable for allowing a consumer to position the retainer in any one of various locations on a refrigerator door.

SUMMARY OF THE INVENTION

The present invention is directed to a retainer assembly for a shelving unit, such as a pick-off bucket, of a refrigerator. More particularly, a retainer having a front wall, a back wall and opposing side walls defining a central opening therein is removably attached to lugs integrally formed in a refrigerator door liner. The retainer is positioned above the shelving unit for preventing tall food items from toppling forward off of the shelving unit when the door is abruptly opened. In accordance with one preferred form of the invention, the retainer assembly further includes a snugger or divider, which may be attached to either the retaining element or the shelving unit, for securing the food items in a snug configuration against one end of the shelving unit.

Additional objects, features and advantages of the invention will become more fully apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
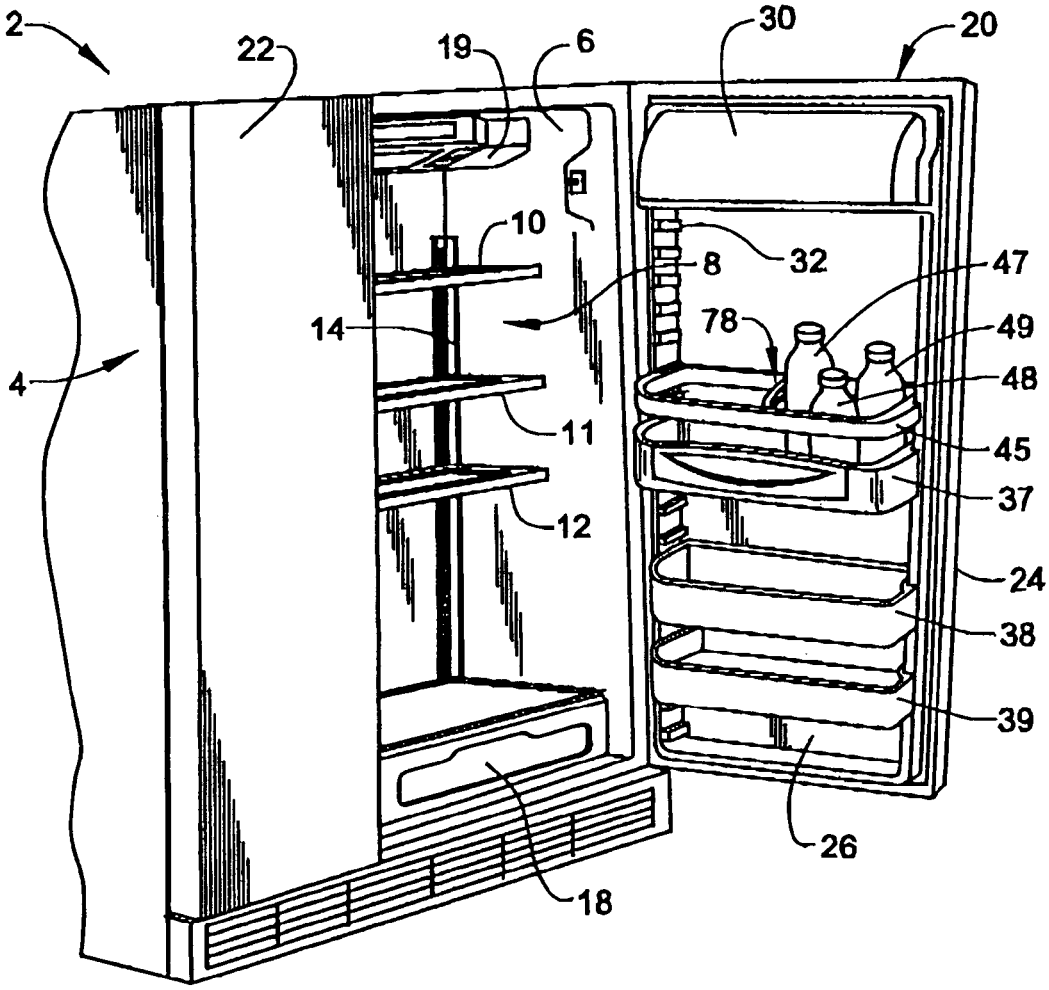
FIG. 1 is a perspective view of a side-by-side refrigerator incorporating a retainer and divider constructed in accordance with the present invention.

With initial reference to FIG. 1, a refrigerator cabinet 2 includes a cabinet shell 4 within which is positioned a liner 6 that defines a fresh food compartment 8. Mounted within fresh food compartment 8 is a plurality of vertically spaced shelves 10-12 which are preferably mounted for selective vertical adjustment upon rear rails, one of which is indicated at 14. At a lowermost portion of fresh food compartment 8, a slidable bin 18 is illustrated. Mounted in an upper region of fresh food compartment 8 is a temperature control housing 19 which, in a manner known in the art, can be used to regulate the temperature in both fresh food compartment 8 and an adjacent freezer compartment (not shown). In a manner also known in the art, fresh food compartment 8 can be accessed by the selective opening of a fresh food door 20. In a similar manner, a freezer door 22 can be opened to access a liner defined freezer compartment (not shown). Fresh food door 20 includes an outer shell 24 and a liner 26 having a plurality of integrally formed lugs 32. Fresh food door 20 is shown to include a dairy compartment 30 and various vertically adjustable shelving units 37-39. In the embodiment shown, each of shelving units 37-39 constitutes a pick-off bucket that can be selectively removed or repositioned on respective lugs 32 provided as part of liner 26 of fresh food door 20.

To this point, the above-described structure is known in the art and presented only for the sake of completeness. The present invention is actually directed to the incorporation of a retainer, which is generally indicated at 45, within refrigerator cabinet 2. In the embodiment shown, retainer 45 is used to prevent various food items, such as those shown at 47-49, from falling from shelving unit 37. However, as will become more fully evident below, retainer 45 of the invention can be employed in connection with a wide range of shelving units.

Figure 2:
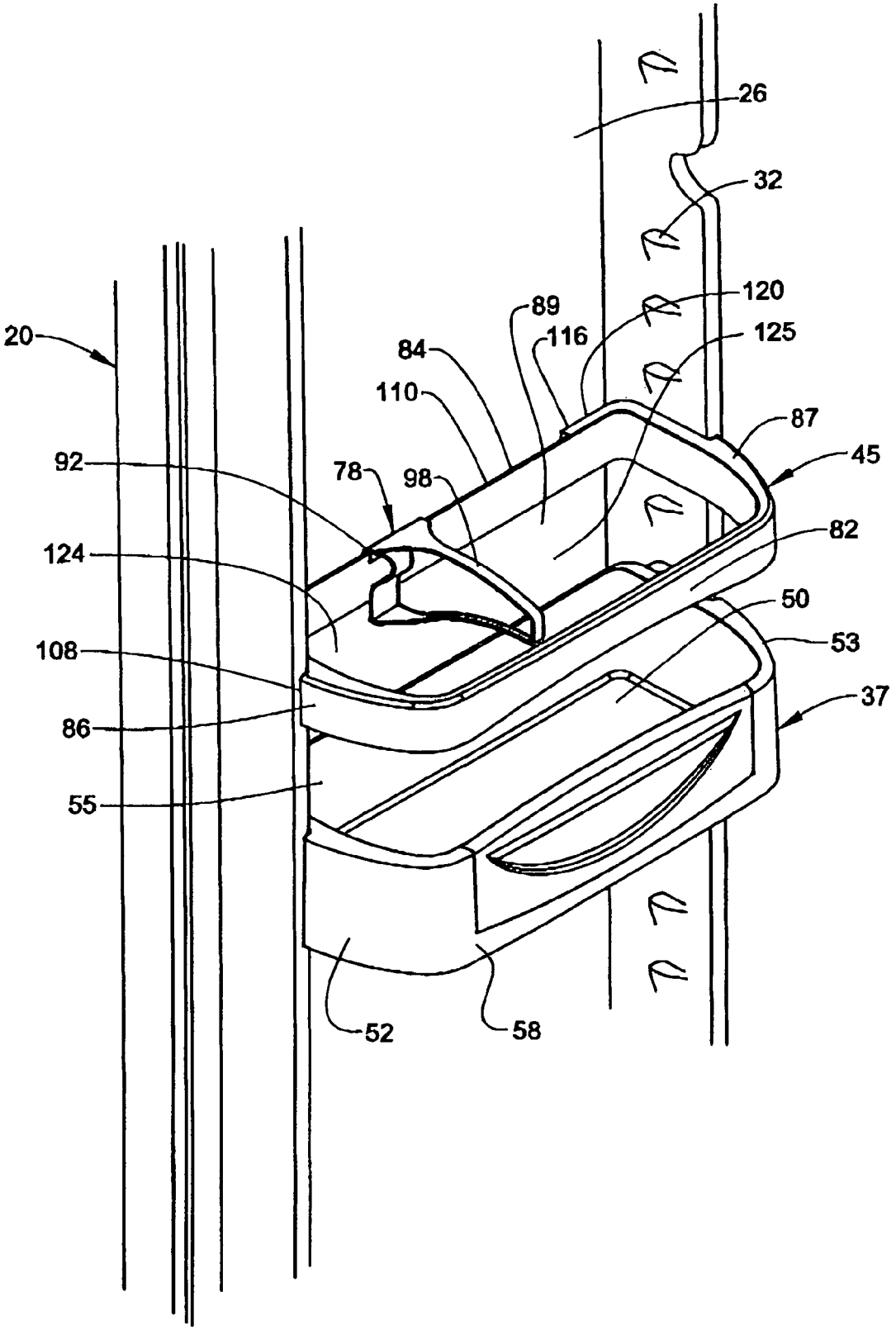
FIG. 2 is an enlarged perspective view of a shelving unit with the retainer and divider of FIG. 1.
Figure 3:
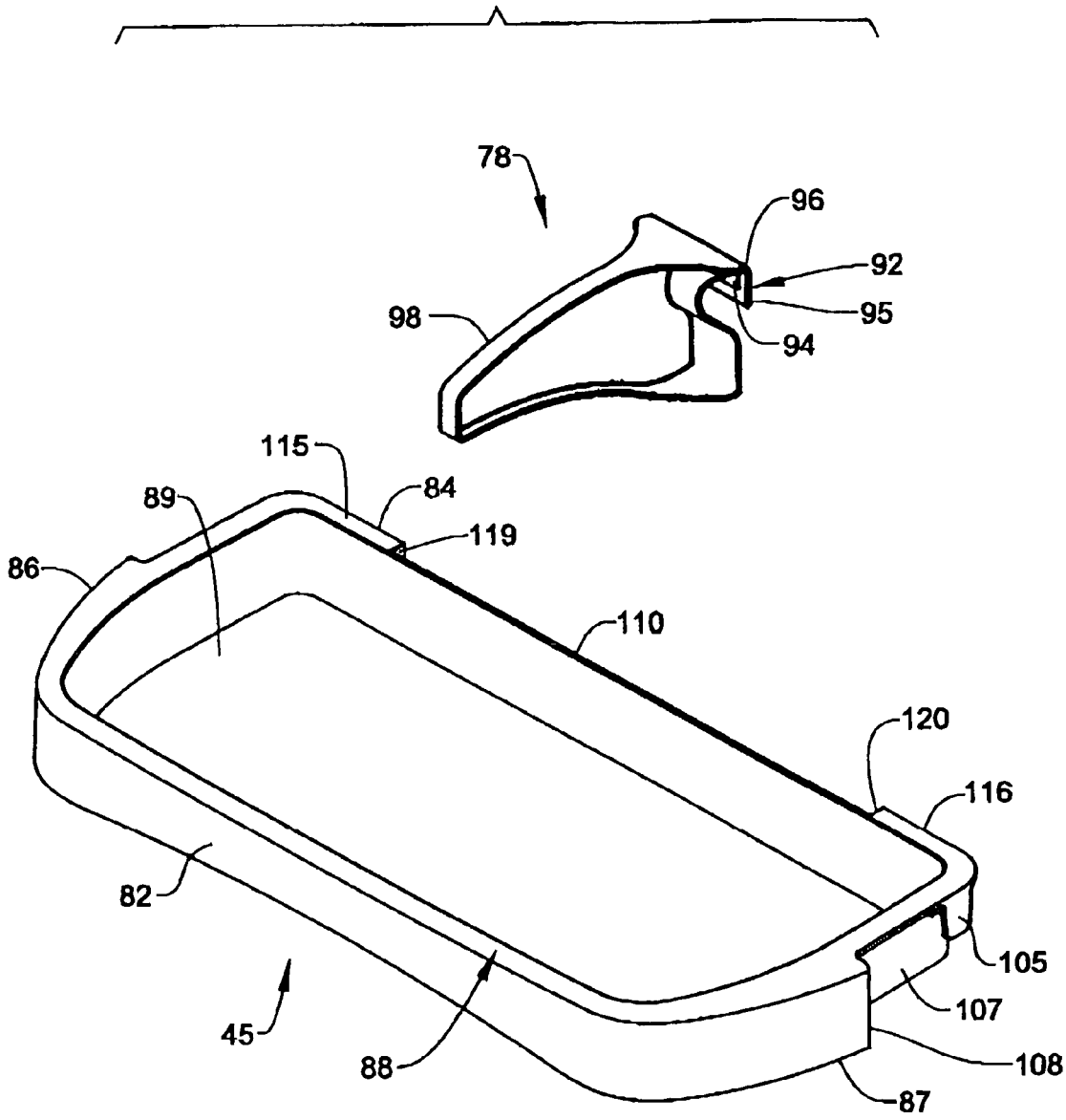
FIG. 3 is an exploded view of the retainer and divider of FIG. 2.
Figure 4:
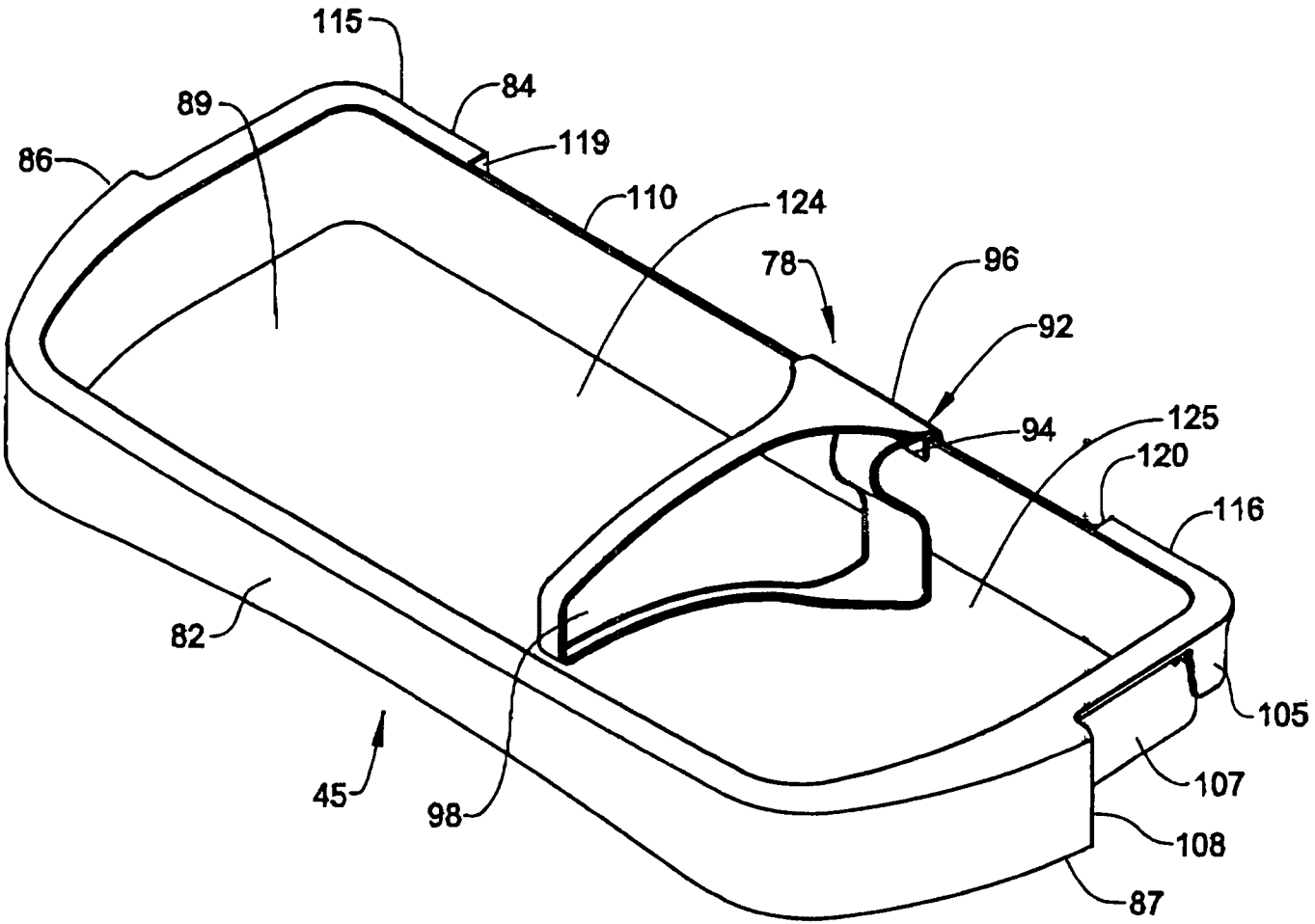
FIG. 4 is an enlarged perspective view illustrating the retainer and divider of FIG. 3.

With reference to FIGS. 2-4, the structure and mounting of retainer 45 in connection with shelving unit 37 will now be described. As indicated above, shelving unit 37 constitutes a pick-off bucket which is preferably, integrally molded of plastic to include a bottom 50, opposing side walls 52 and 53, a rear wall 55 and a front wall 58. The exact configuration of shelving unit 37 can vary, particularly depending on the construction of liner 26 and the manner in which shelving unit 37 is removably attached thereto. In any case, pick-off buckets and various other types of shelving units which could be employed in connection with the present invention are widely known in the art. More importantly, in connection with the present invention, positioned above shelving unit 37 is retainer 45. In the embodiment shown, attached to retainer 45 is a snugger or divider 78. Preferably, each of retainer 45 and divider 78 is molded of plastic. In general, retainer 45 includes a front wall 82, a back wall 84, and opposing side walls 86 and 87 defining a ring having a central opening 89 therein. Divider 78 includes a support component 92 having a first or front flange portion 94, a second or rear flange portion 95 which is spaced from and substantially parallel to front flange portion 94, and an upper portion 96 interconnecting the front flange and rear flange portions 94 and 95. Divider 78 also includes a dividing component 98 which extends forward from upper portion 96 of support component 92.

Retainer 45 is adapted to be selectively, removably attached to inner liner 26. As shown in FIGS. 3 and 4, side walls 86 and 87 of retainer 45 are integrally molded with an attachment member 105 and a receiving area 107, which is located just forward of attachment member 105. Attachment member 105 and receiving area 107 are adapted to cooperate with lugs 32 of door liner 26, along with each side edge 108 of side walls 86 and 87, in order to support retainer 45 on door liner 26. Since retainer 45 is attached to door liner 26 in a manner similar to the attachment method of shelving unit 37, which is widely known in the art, it will not be further discussed in detail herein. In general, the particular attachment structure employed for retainer 45 would simply, preferably be the same use for the specific shelving unit support structure utilized.

In any case, with this arrangement, retainer 45 can be selectively positioned at a desired height above shelving unit 37 to prevent food products 47-49 from falling from shelving unit 37 when fresh food door 20 is opened. That is, bottom portions of food products 47-49 rest on shelving unit 37, while top portions of food products 47-49 extend through central opening 89 of retainer 45, such that front wall 82 of retainer 45 prevents food items 47-49 from falling from shelving unit 37.

Formed within back wall 84 of retainer 45 is an elongated recess portion 110 shown intermediate end sections 115 and 116 that lead to side walls 86 and 87 respectively. Given this construction, back wall 84 defines a pair of laterally spaced, fore-to-aft extending back wall portions 119 and 120. As will be described in detail below, back wall portions 119 and 120 define end stops for the sliding movement of divider 78.

In use, divider 78 is attached to retainer 45, with support component 92 being attached along elongated recess portion 110 of back wall 84 such that back wall 84 fits between front and rear flange portions 94 and 95 of support component 92. Preferably, back wall 84 of retainer 45 abuts liner 26 when retainer 45 is in position. Therefore, elongated recess portion 110 provides a clearance for divider 78 to freely slide within elongated recess portion 110 without rear flange portion 95 contacting liner 26. In any event, divider 78 is attached to retainer 45 for sliding movement between points defined by back wall portions 119 and 120, while dividing component 98 projects towards front wall 82 of retainer 45. Alternatively, divider 78 may be attached to rear wall 55 of shelving unit 37 in a corresponding manner. In either configuration, divider 78 functions to enhance the retention of food items 47-49 by separating shelving unit 37, which is located below divider 78, into separate storage zones 124 and 125.

Based on the permissible shifting of divider 78, storage zones 124 and 125 have varying areas and volumes depending on the position of divider 78. As described above, divider 78 can be readily slid along elongated recess portion 110 by a consumer in order to alter the particular storage configuration of shelving unit 37. When tall food product containers 47-49 are arranged upon bottom 50 of shelving unit 37 between side wall 53 and divider 78, as illustrated in FIG. 1, divider 78 will retain food product containers 47-49 against side wall 53 in a snug configuration, thereby preventing undesirable shifting of food product containers 47-49 when door 20 is abruptly opened and closed.

Although described with reference to a preferred embodiment of the invention, it should be readily apparent that various changes and/or modifications can be made to the invention without departing from the spirit thereof. It should be recognized that the particular construction of the retainer and divider, as well as the manner and location of attachment of the retainer to the door liner or the divider to the retainer/shelving unit, can vary in accordance with the invention. In any case, the invention is only intended to be limited to the scope of the following claims.

We claim:

1. A refrigerator comprising:

a cabinet defining a food compartment;

a door attached to and movable relative to the cabinet in order to selectively access the food compartment, said door including an outer panel and an inner liner;

a shelving unit attached to the liner;

a retainer including a front wall, a back wall, and two opposing side walls each having an attachment member formed integrally thereon, wherein the front wall, back wall, and side walls are interconnected to define a ring with a central opening, wherein the back wall of the retainer abuts the inner liner of the door and includes an elongated recess portion formed therein, the elongated recess portion having two spaced apart opposing end portions, the retainer being removably attached to the liner by securing the attachment members directly to the liner at a position spaced vertically above the shelving unit, wherein a tall food item can be positioned with a lower portion supported on the shelving unit and an upper portion extending through the central opening of the retainer, such that the retainer aids in preventing the tall food item from falling from the shelving unit;

a divider for laterally retaining the food item on the shelving unit, said divider being attached to one of the front and back walls of the retainer and to the retainer at the elongated recess portion, wherein said divider fits over the back wall at the elongated recess portion, while being spaced from the refrigerator door liner; and first and second sets of vertically spaced apart and substantially identically constructed lugs formed on the inner liner, said shelving unit being supported on the first set of lugs and said retainer being supported on the second set of lugs.

2. The refrigerator according to claim 1 wherein the divider includes a support component and a dividing component, said support component being attached to the retainer for sliding movement along the elongated recess portion and the dividing component projecting into the central opening of the retainer.

3. The refrigerator according to claim 1, wherein the two spaced apart opposing end portions of the elongated recess portion define end stops for sliding movement of the divider.

4. The refrigerator according to claim 1, wherein the retainer can be selectively, vertically repositioned on the inner liner of the door relative to the shelving unit.

* * * * *